United States Patent [19]

Kunka et al.

[11] 4,211,350

[45] Jul. 8, 1980

[54] WIRE STITCHING MACHINE

[75] Inventors: Bernard P. Kunka; George B. Simonelic, both of Racine, Wis.

[73] Assignee: Interlake, Inc., Oak Brook, Ill.

[21] Appl. No.: 958,715

[22] Filed: Nov. 8, 1978

[51] Int. Cl.[2] ..... B27F 7/12; B27F 7/24

[52] U.S. Cl. ..... 227/8; 227/90

[58] Field of Search ..... 227/8, 83, 84, 85, 86, 227/87, 88, 89, 90, 91, 92

[56] References Cited

U.S. PATENT DOCUMENTS

| | | | |
|---|---|---|---|
| 1,628,848 | 5/1927 | Kingman | 227/83 |
| 2,347,908 | 5/1944 | Hoffert | 227/8 |
| 2,554,691 | 5/1951 | Zeruneith | 227/84 |
| 2,839,753 | 6/1958 | Reed et al. | 227/83 |
| 2,960,695 | 11/1960 | Hausknecht | 227/90 X |

*Primary Examiner*—Paul A. Bell

*Attorney, Agent, or Firm*—Vogel, Dithmar, Stotland, Stratman & Levy

[57] ABSTRACT

A wire stitching machine includes a head frame carrying a support, a staple former and a staple driver all reciprocally movable with respect to the head frame under the action of a single reciprocating drive bar coupled by crank mechanism to a rotary drive means. Wire feed rolls and a wire-supporting anvil are carried by the support. The support, staple former and staple driver are so coupled to each other and to the reciprocating drive bar that during a first portion of its drive stroke all three are moved to the associated workpiece and during a second portion of the drive stroke the support is arrested while the staple former and staple driver continue moving to form the staple and during a third portion of the drive stroke the staple former is arrested while only the staple driver continues moving to drive the formed staple into the workpiece. The anvil includes a forming shoe and is of integral one-piece construction movable as a unit between forming and driving positions. An improved clutch is provided for the rotary drive means, along with a finger guard coupled to the clutch which provides easy access and maximum working space to load the machine, yet provides effective guarding during stitching and prevents actuation of the clutch when a user's hand is in the stapling region.

31 Claims, 16 Drawing Figures

WIRE STITCHING MACHINE

BACKGROUND OF THE INVENTION

The present invention relates to a wire stitching or stapling machine of the type which severs and forms staples from a continuous wire and drives the staples into an associated workpiece. Such machines are typically useful in the stapling or stitching together of the cover flaps of cartons, fiberboard boxes or the like, as well as other types of heavy-duty stapling.

Such stitching machines have previously been available, typical prior art machines being illustrated in U.S. Pat. Nos. 2,194,225 issued to R. G. Hoffert on Mar. 19, 1940 and 2,960,695 issued to W. E. Hausknecht on Nov. 22, 1960. But these prior art machines have utilized a complicated drive assembly entailing separate drive means for the staple former and the staple driver, and still another drive means for the wire feed rolls, which construction entailed considerable manufacturing and assembly expense.

Also, there prior art stitching machines utilize a forming anvil and a separate supporting shoe for cooperation with a reciprocating staple former, the anvil and shoe being separately movable out of the path of the staple driver in opposite directions. This arrangement necessitates that the staple former have apertures cut in both the front and back thereof to accommodate the movement of the anvil and shoe, thereby requiring additional space to accommodate the anvil and shoe and weakening the reciprocating staple former.

These prior art stitching machines also utilize wire feed rolls which, in addition to being separately driven, are rotatable for simultaneously withdrawing the wire from the supply roll and feeding it to the staple forming and driving means.

In addition, the prior art wire stitching machines have a relatively complicated clutch mechanism for coupling the drive shaft to a motor-driven drive wheel. Furthermore, while prior machines have provided guards to prevent accidental injury to a user's hand during operation of the stitching head in driving a staple into an associated workpiece, these guards limit the space available for maneuvering the workpiece.

SUMMARY OF THE INVENTION

The present invention provides an improved wire stitching machine which overcomes the disadvantages of prior art machines, while affording additional structural and operational advantages.

It is an important object of this invention to provide a wire stitching machine which utilizes a simple down-and-up reciprocating drive bar which drives both the staple former and the staple driver.

Another object of this invention is to provide a wire stitching machine which includes an integral onepiece anvil having a shoe portion thereon, the anvil being movable as a unit between forming and driving positions.

Still another object of this invention is the provision of a movable support on which the anvil is carried so that the staple former and staple driver are movable with the anvil and support to the workpiece and are then movable with respect to the anvil and support for forming and driving the staple.

In connection with the foregoing object, still another object of this invention is the provision of a stitching machine wherein the wire feed rolls are carried on the movable support and are adapted non-rotatably to grip the wire during a drive stroke for withdrawing wire from a supply roll and are rotatable during a retraction stroke to feed the withdrawn wire to the anvil.

Still another object of this invention is the provision of an improved and simplified clutch mechanism including a clutch member which is carried by the drive shaft for rotation therewith and for pivotal movement with respect thereto.

Another object of the invention is the provision of a finger guard coupled to the clutch-actuating mechanism to provide maximum working space for loading, yet to prevent engagement of the clutch and operation of the stitching machine when a user's hand is in the stitching region.

More specifically, an object of this invention is to provide, in a wire stitching machine including a head frame and staple-forming and driving mechanism and operating means therefor, the combination comprising a support adapted for movement with respect to the head frame, and anvil member coupled to the support for movement therewith and adapted for holding an associated length of wire, and coupling means coupling the operating means to the staple-forming and driving mechanism and to the support for effecting movement thereof, the coupling means being responsive to an initial movement of the operating means for effecting simultaneous movement of the staple-forming and driving mechanism and the support, the coupling means being responsive to further movement of the operating means for arresting movement of the support with respect to the head frame while permitting continued movement of the staple-forming and driving mechanism with respect to the support and the head frame.

Further features of the invention pertain to the particular arrangement of the parts of the wire stitching machine whereby the above-outlined and additional objects thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENT

Figure 1:
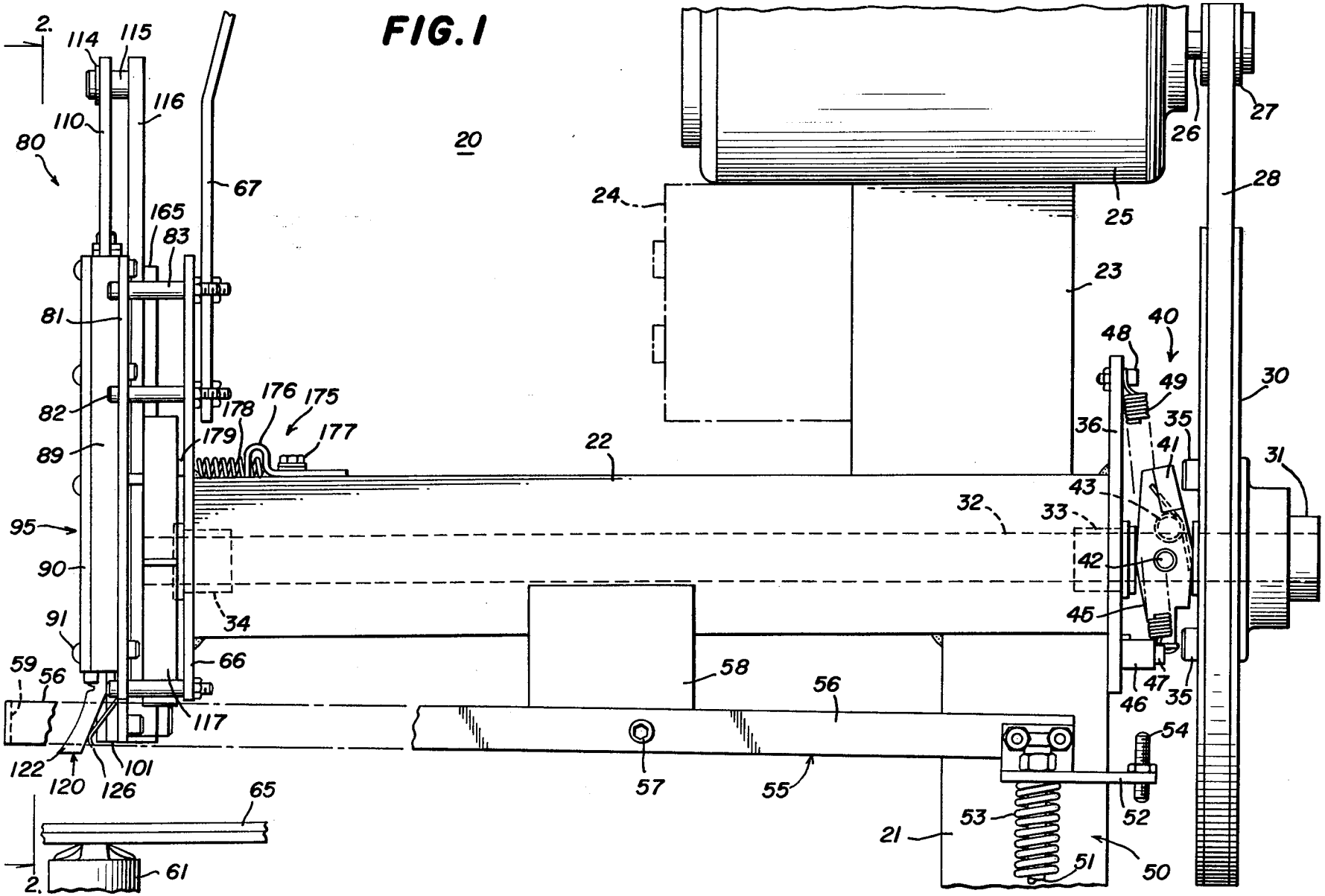
FIG. 1 is a fragmentary side elevational view of a wire stitching machine constructed in accordance with and embodying the features of the present invention, with portions thereof broken away more clearly to illustrate the construction thereof.
Figure 2:
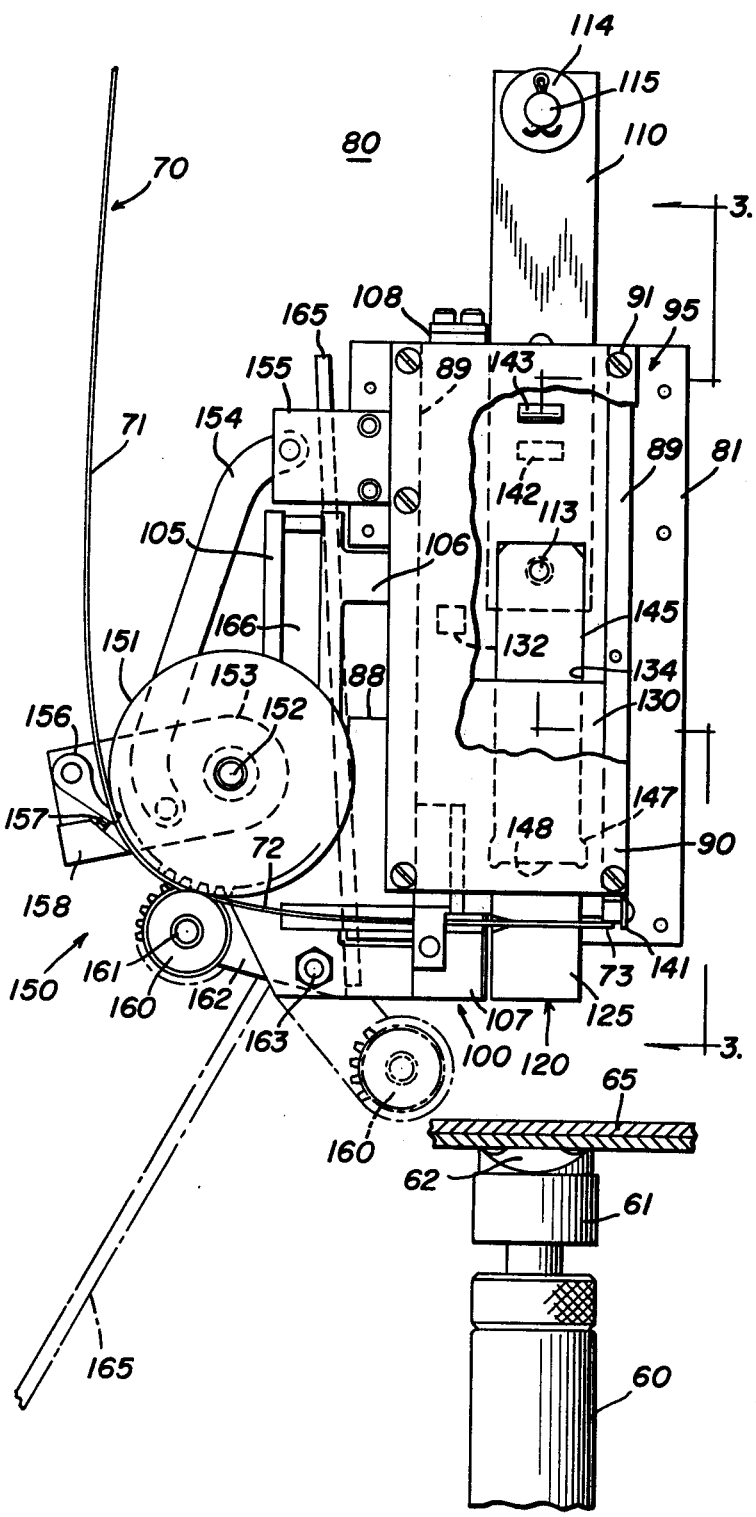
FIG. 2 is a fragmentary front elevational view, taken along the line 2—2 in FIG. 1, illustrating the machine in an initial retracted position, with a portion of the cover plate broken away to show the interior of the stitching head.
Figure 3:
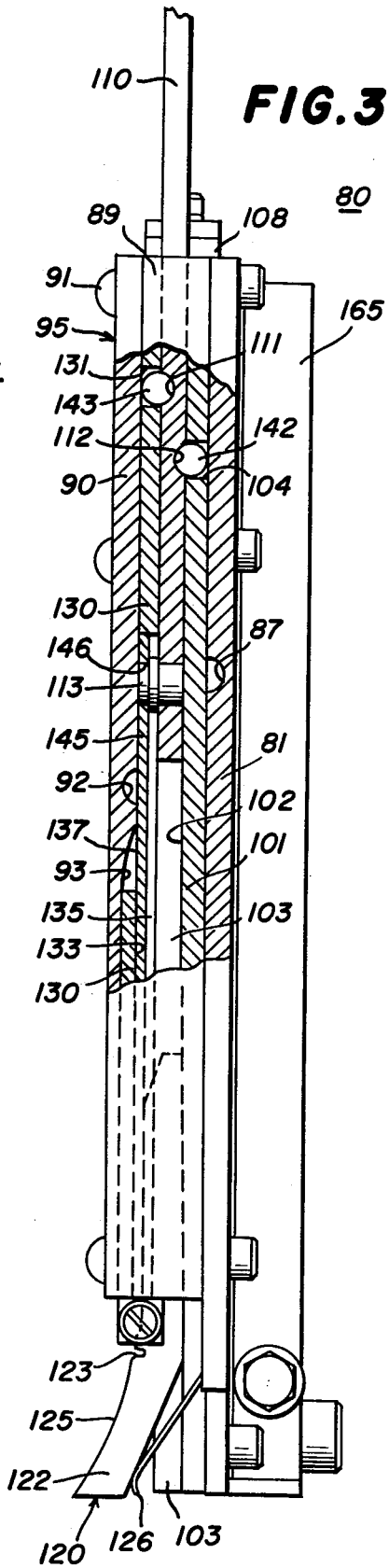
FIG. 3 is an enlarged fragmentary view in vertical section taken along the line 3—3 in FIG. 2.

Referring now to FIGS. 1 through 3 of the drawings, there is illustrated a wire stitching machine, generally designated by the numeral 20, which includes a stitching head 80 adapted for withdrawing a continuous wire 70 from an associated coil thereof, feeding the leading end thereof to an anvil 120, severing the leading end and forming it into a staple over the anvil 120 and then driving it through a workpiece 65 and against a clincher 61 for clinching or closing the staple.

The wire stitching machine includes a mounting base (not shown) having connected thereto adjacent to the rear end thereof and extending vertically upwardly therefrom a support post 21. Fixedly secured to the support post 21 at the upper end thereof and extending forwardly therefrom substantially horizontally is a hollow crossbar 22 having a mounting plate 23 secured thereto adjacent to the rear end thereof and extending upwardly therefrom. Carried on the mounting plate 23 is an electrical control box 24 and an electric drive motor 25 having an output shaft 26 on which is fixedly secured a sheave 27, the sheave 27 being coupled by a drive belt 28 to a large drive wheel 30. The drive wheel 30 is freely rotatably mounted by means of a drive collar 31 and suitable bearings (not shown) on one end of the drive shaft 32, which extends forwardly through the crossbar 22 and is journaled at the rear and front ends thereof in bearings 33 and 34. Fixedly secured to the inner surface of the drive wheel 30 and projecting forwardly therefrom are two diametrically spaced-apart drive lugs 35, which may be the heads of socket-head capscrews. Fixedly secured to the rear end of the crossbar 22 is a vertically extending mounting plate 36.

There is also provided a clutch assembly, generally designated by the numeral 40, which includes a clutch member 41 tangentially mounted on the drive shaft 32 by means of a clutch pin 42, the clutch member 41 being pivotally movable with respect to the clutch pin 42 in clockwise and counterclockwise directions, as viewed in FIG. 1. Carried on the drive shaft 32 is a torsion spring 43 which bears against the clutch member 41 and resiliently urges the clutch member 41 toward a drive position rotated a slight distance clockwise from the position illustrated in FIG. 1, so that the upper end thereof is in the path of the drive lugs 35 for driving engagement thereby. The lower end of the clutch member 41 comprises a cam finger 45 disposed for camming engagement with a clutch plate 46, which is an elongated member extending into the plane of the paper in FIG. 1 and pivotally mounted intermediate the ends thereof on the mounting plate 36 by a pivot pin 47. The inner end of the clutch plate 46 is coupled by a helical tension spring 49 to an anchor stud 48 at the upper end of the mounting plate 36. The spring 49 resiliently urges the clutch plate 46 to a deactuating position, illustrated in FIG. 1, for camming engagement with the camming finger 45 of the clutch member 41 to hold the clutch member 41 in its release position, illustrated in FIG. 1, tilted out of the path of the drive lugs 35.

The clutch plate 46 is operated by a clutch actuating assembly, generally designated by the numeral 50, which includes a generally vertically disposed spring rod 51, the lower end of which is fixedly secured to a connecting rod (not shown) which is in turn coupled to a foot pedal assembly (not shown). The upper end of the spring rod 51 is slidably received through an opening in a lever bracket 52, which cooperates with the upper end of the connecting rod to trap therebetween a helical compression spring 53 disposed in surrounding relationship with the spring rod 51. Secured to the rear end of the lever bracket 52 is a stud 54 positioned for engagement with the clutch plate 46. Also secured to the lever bracket 52 is the rear end of the main arm 56 of a finger guard 55, the main arm 56 extending forwardly of the machine 20 and being pivotally mounted intermediate the ends thereof by a pivot pin 57 on a mounting bracket 58 carried by the crossbar 22. The main arm 56 is integral at its forward end with a front arm 59 extending horizontally therefrom substantially normal thereto into the plane of the paper in FIG. 1 forwardly of the stitching head 80.

Also secured to the base and extending upwardly therefrom at the front end thereof immediately beneath the stitching head 80 is a clincher post 60 carrying at the upper end thereof a clincher 61 having staple guide surfaces 62. In use, the clincher 61 is positioned immediately beneath the stitching head 80 and is adapted for supporting thereon an associated workpiece 65, which may, for example, be a pair of carton flaps to be stapled together.

Figure 6:
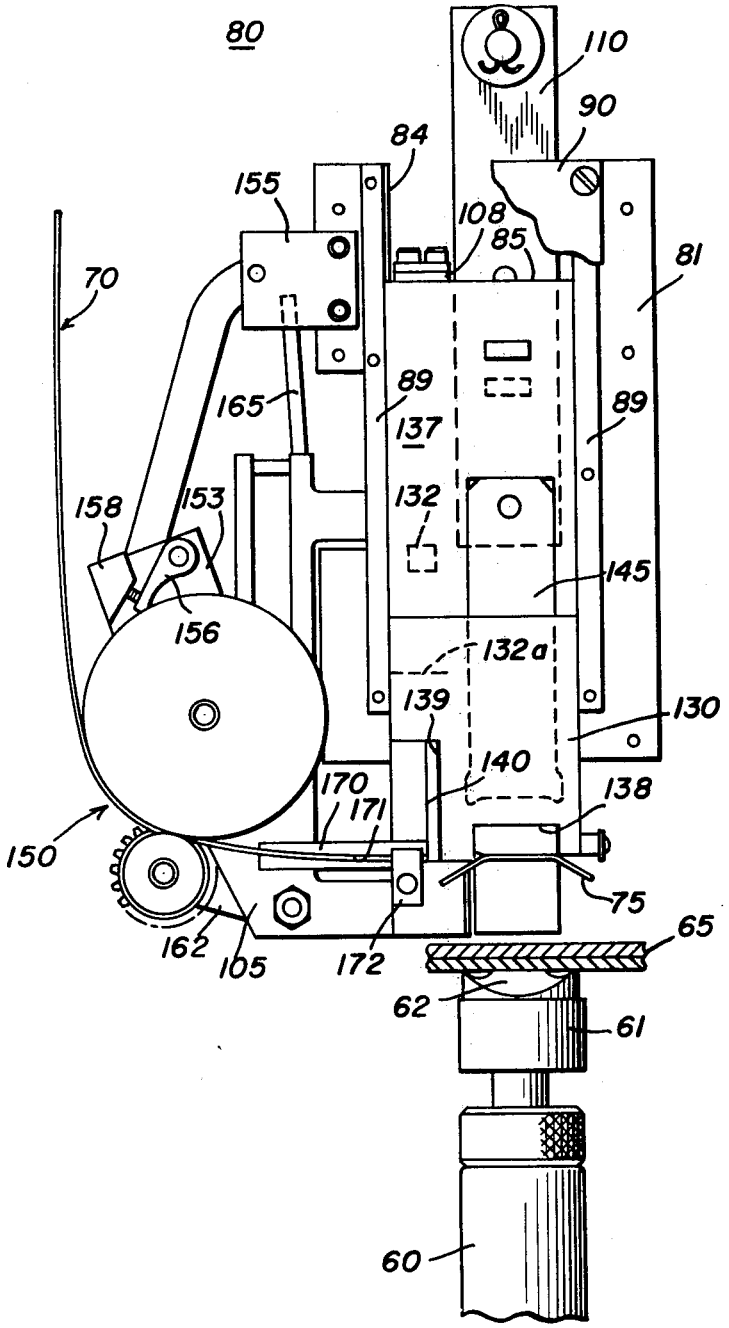
FIG. 6 is a view similar to FIGS. 2 and 4 and illustrating the parts further along a drive stroke with the staple severed and partially formed.
Figure 7:
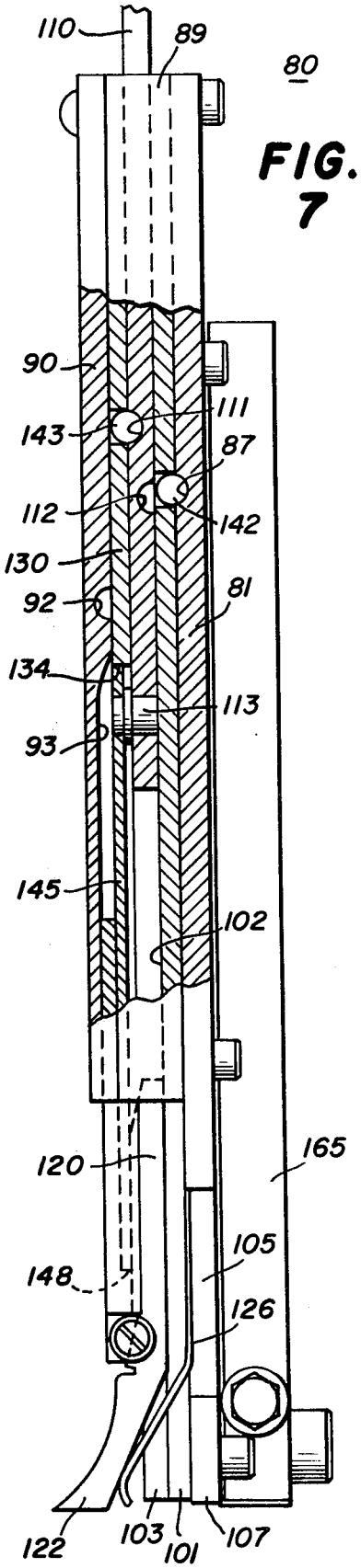
FIG. 7 is a view similar to FIGS. 3 and 5, but illustrating the parts in the position shown in FIG. 6.

Fixedly secured to the front end of the crossbar 22 is a vertically extending support plate 66. Secured to the upper end of the support plate 66 and extending upwardly therefrom is a coil mounting arm 67 rotatably supporting adjacent to the upper end thereof an associated coil or spool (not shown) of continuous wire 70, a supply portion 71 of which extends downwardly from the coil to a feed portion 72 which is fed into the stitching head 80 and terminates at a leading end 73 for formation of a staple 75 (see FIG. 6, for example).

The stitching head 80 is a flat, generally rectangular box-like construction disposed substantially vertically in use, and includes a flat rear plate 81 disposed forwardly of the support plate 66 substantially parallel thereto, being mounted thereon by fasteners 82 and spaced therefrom by spacers 83. The rear plate 81 is irregularly shaped, having at the upper end thereof a cutout 84 defining a stop surface 85 (see FIGS. 4 and 6), and having a cutout 88 along the left side thereof, as viewed in FIG. 2. The inner or front surface of the rear plate 81 has formed therein adjacent to the upper end thereof a semicylindrical recess 87 and has fixedly secured thereto and extending forwardly therefrom a pair of laterally spaced-apart vertically-extending side rails 89. Spanning the side rails 89 at the front edges thereof and fixedly secured thereto by screws 91 is a flat rectangular front plate 90, having formed on the inner or rear surface thereof a semicylindrical recess 92 and an elongated channel-shaped relieved portion 93.

The rear plate 81, side rails 89 and front plate 90 cooperate to form a rectangular hollow head frame open at the upper and lower ends thereof, and generally designated by the numeral 95. Movable with respect to the head frame 95 is a support assembly, generally designated by the numeral 100, which includes a generally rectangular flat slide plate 101 dimensioned to fit between the side rails 89 for sliding engagement therealong and along the inner surface of the rear plate 81. The front or inner surface of the slide plate 101 has an elongated, vertically-extending channel or groove formed therein having a bottom surface 102 and side surfaces 103 (see FIGS. 3 and 8). The slide plate 101 has a rectangular aperture 104 extending therethrough and positioned adjacent to the upper end thereof laterally centrally of the channel bottom surface 102.

The support assembly 100 also includes a support plate 105 which is disposed substantially parallel to the slide plate 101 to the left of the head frame 95, as viewed in FIG. 2, and includes upper and lower attachment arms 106 and 107 which are fixedly secured to the rear surface of the slide plate 101 by suitable fastening means, the attachment arm 106 being accommodated by the side cutout 88 in the rear plate 81, and the attachment arm 107 being secured to a bottom portion of the slide plate 101 which extends downwardly below the rear plate 81. Fixedly secured to the upper edge of the slide plate 101 and extending rearwardly therefrom is a stop pad 108. Integral with the channel bottom surface 102 adjacent to the lower end thereof and projecting forwardly therefrom is an attachment pin 109 (see FIG. 9) for a purpose to be described below.

The movement of the support assembly 100 with respect to the head frame 95 is effected by a vertically-extending drive bar 110, which is dimensioned to be received in the slide plate channel in sliding engagement with the bottom surface 102 and side surfaces 103 thereof, with the front surface of the drive bar 110 being substantially flush with the front surface of the slide plate 101. Formed in the front surface of the drive bar 110 is a semicylindrical front recess 111, and formed in the rear surface thereof a slight distance below the front recess 111 is a semicylindrical rear recess 112. Fixedly secured to the drive bar 110 adjacent to the lower end thereof and projecting forwardly therefrom is an attachment pin 113.

Received through a complementary aperture in the upper end of the drive bar 110 and secured thereto by a retaining ring 114 is a pivot pin 115 fixedly secured to the upper end of a drive link 116 which extends downwardly behind the rear plate 81 of the stitching head 80 and is pivotally coupled adjacent to its lower end by a suitable wrist pin (not shown) to a crank 117. The crank 117 is generally in the shape of an enlarged rectangular plate with truncated corners and is provided with a central aperture therethrough in which is received the forward end of the drive shaft 32, the crank 117 being fixedly secured to the drive shaft 32 just forwardly of the support plate 66, as by a suitable pin (not shown). It will be appreciated that rotation of the drive shaft 32 rotates the crank 117, thereby imparting a vertically reciprocating motion to the drive bar 110 via the link 116 for sliding the drive bar 110 downwardly and upwardly in the channel of the slide plate 101 through drive and retraction strokes.

Figure 9:
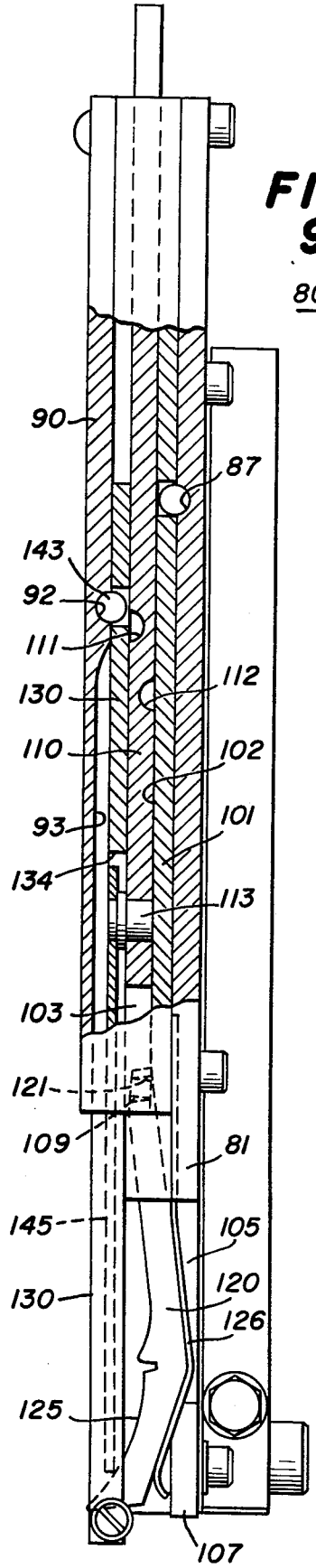
FIG. 9 is a view similar to FIG. 7, but illustrating the parts in the position shown in FIG. 8.

Also disposed in the channel of the slide plate 101 is an anvil, generally designated by the numeral 120, which is provided at the upper end thereof with an aperture 121 in which is received the attachment pin 109 of the slide plate 101 (see FIG. 9). The anvil 120 extends downwardly below the head frame 95 and is provided at the lower end thereof with a forwardly-inclined shoe portion 122 having a laterally-extending groove 123 in the front surface thereof for accommodating the wire 71 in a manner to be described more fully below. The front surface of the anvil 120 also defines an upper camming surface 124 just above the groove 123 and a lower camming surface 125 beneath the groove 123. The aperture 121 in the anvil 120 is slightly larger than the pin 109 to accommodate a rearward tilting movement of the anvil 120 between a forming position illustrated in FIG. 3 and a driving position illustrated in FIG. 11, this tilting movement being accommodated by cutouts at the lower ends of the rear plate 81 and slide plate 101. Fixedly secured to the rear surface of the slide plate 101 is the upper end of a leaf spring 126, the lower end of which engages the rear surface of the anvil 120 resiliently to urge it forwardly to the forming position illustrated in FIG. 3.

Figure 4:
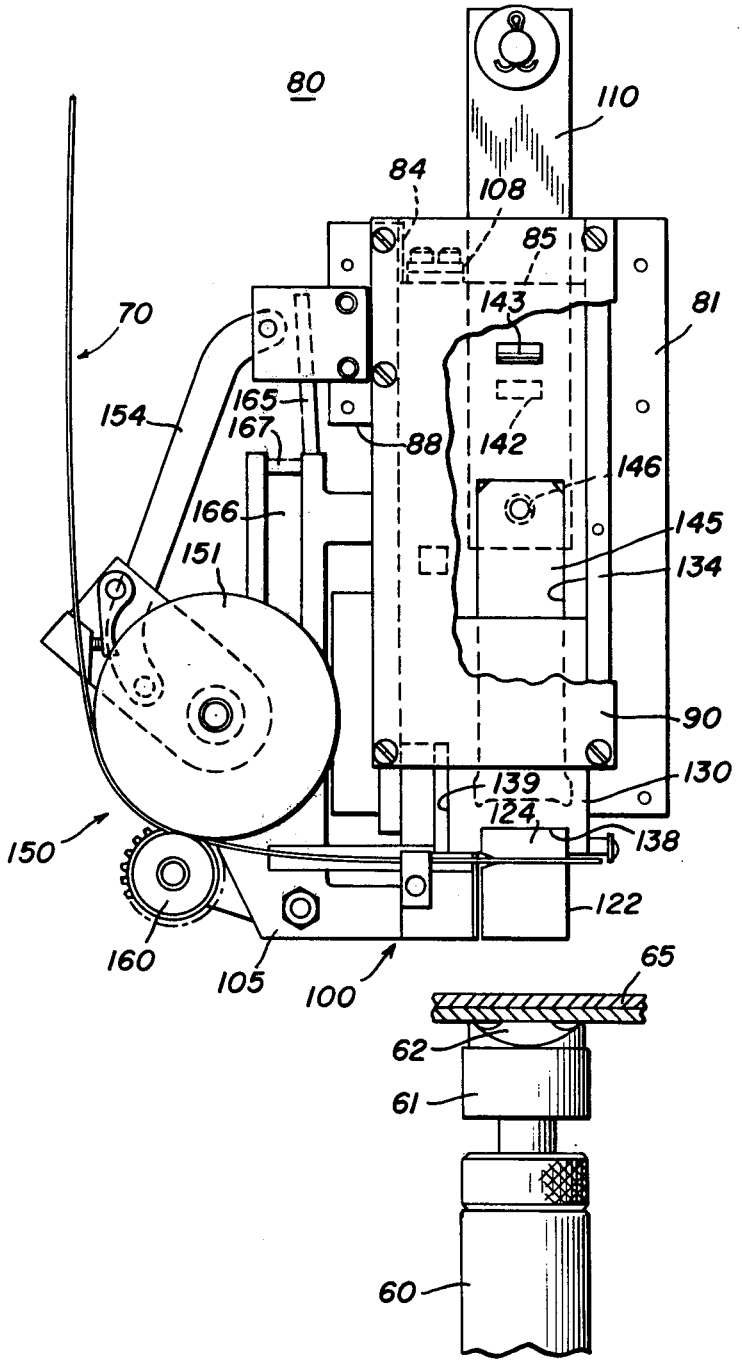
FIG. 4 is a view similar to FIG. 2, illustrating the positions of the parts at the end of a first portion of a drive stroke with the anvil support partially extended.

Disposed in front of the drive bar 110 within the head frame 95 is a generally rectangular staple former 130, the front surface of which is relieved along the upper portion thereof as at 137 (see FIGS. 3 and 6), the unrelieved lower portion of the front surface being accommodated in the relieved portion 93 of the front plate 90. Extending through the staple former 130 adjacent to the upper end thereof is a rectangular aperture 131. Projecting rearwardly from the rear surface of the staple former 130 is a stud 132 (see FIG. 2) which travels in a complementary recess in the front surface of the slide plate 101, the lower end of which defines a stop surface **132*a* and the upper end of which defines a stop surface 132*b* (see FIGS. 8, 13 and 15). Formed in the rear surface of the staple former 130 is a vertically-extending rectangular channel having a bottom or forward surface 133 and side walls 135, the channel having a depth so that it extends all the way through the relieved front surface 137 to form a rectangular opening 134. Formed in each of the channel side walls 135 at the lower ends thereof are vertically-extending staple grooves 136 (see FIGS. 8 and 12) for a purpose to be described more fully below. The lower end of the staple former 130 is cut out as at 138 (see FIG. 4) and the left side of the staple former, as viewed in FIG. 4, is cut out at the lower end thereof as at 139 and has fixedly secured thereto a cutter blade 140. Secured to the right-hand edge of the staple former 130 at the lower end thereof, as viewed in FIG. 2, by a suitable fastener and spacer, is a wire stop washer 141**.

Respectively received in the slide plate aperture 104 and the staple former aperture 131 are horizontally-extending cylindrical shift pins 142 and 143. The shift pin 142 is dimensioned to be partially receivable in the recess 87 in the rear plate 81 and the recess 112 in the drive bar 110, and has a diameter greater than the thickness of the slide plate 101 so that it must, at all times, be partially disposed either in the recess 87 or the recess 112. Similarly, the shift pin 143 is dimensioned to be partially received in the recess 92 of the front plate 90 and the recess 111 of the drive bar 110 and has a diameter greater than the thickness of the relieved upper portion of the staple former 130 so that it must, at all times, be partially disposed either in the recess 92 or the recess 111.

Disposed in the channel of the staple former 130 for sliding engagement with the channel bottom 133 and channel side walls 135 is an elongated, flat, rectangular staple driver 145 provided at the upper end thereof with an aperture 146 therethrough for receiving therein the attachment pin 113 of the drive bar 110, whereby the staple driver 145 is reciprocatively movable with the drive bar 110. The lower end of the staple driver 145 has outwardly flared side flanges 147 respectively receivable in the staple grooves 136 of the staple former 130 (see FIG. 12), the lower end of the staple driver 145 defining a drive surface 148.

In operation, as the drive bar 110 moves downwardly from the fully retracted position illustrated in FIGS. 2 and 3, it drives the support assembly 100 and the staple former 130 downwardly by the coupling action of the shift pins 142 and 143 and drives the staple driver 145 downwardly by the coupling action of the attachment pin 113.

Carried by the support plate 105 of the support assembly 100 is a wire feed assembly, generally designated by the numeral 150, which includes a large feed roll 151 rotatably mounted on a shaft 152 carried by the support plate 105. Also rotatably mounted on the shaft 152 is a feed lever 153, having pivotally coupled thereto one end of a feed link 154, the other end of which is pivotally coupled to a mounting bracket 155 secured to the rear plate 81 of the head frame 95. Pivotally mounted on the feed lever 153 is a pawl 156 which is resiliently urged into ratcheting engagement with gear teeth around the perimeter of the feed roll 151 by means of a bias spring 157 carried by a spring block 158 on the feed lever 153.

The wire feed assembly 150 also includes a small feed roll 160 rotatably mounted on a shaft 161 carried by a mounting arm 162, which is in turn pivotally mounted on the support plate 105 by a pivot pin 163 between the positions illustrated in solid line and broken line in FIG. 2. The feed roll 160 is provided with gear teeth around the perimeter thereof adapted for meshing engagement with the teeth of the feed roll 151. Each of the feed rolls 151 and 160 also includes a wire feed surface around the perimeter thereof for cooperation to grip the feed portion 72 of the wire 71 therebetween when the feed rolls 151 and 160 are disposed in meshing engagement with each other. Fixedly secured to the inner end of the mounting arm 162 and extending upwardly therefrom is an elongated spring arm 165. Secured to the front surface of the support plate 105 and extending upwardly therealong is a resilient latch band 166 provided at the upper end thereof with a latch hook 167 (see FIG. 4) which extends over the top of a support plate 105 and rearwardly thereof for latching engagement with the spring arm 165 to hold it in the position illustrated in FIG. 2, wherein the feed roll 160 is firmly urged into feeding engagement with the feed roll 151.

Fixedly secured to the slide plate 101 at the lower end thereof beneath the head frame 95 is a wire guide block 170 having an elongated, generally horizontally-extending guide groove 171 in the front surface thereof (best illustrated in FIGS. 6 and 12) for receiving the feed portion 72 of the wire 71 from the wire feed assembly 150 and guiding it to the groove 123 in the anvil 120. A retainer 172 is secured to the lower end of the slide plate 101 and overlies the inner end of the wire guide block 170 for retaining the wire in the guide groove 171.

Mounted on the crossbar 22 at the front end thereof is a brake assembly, generally designated by the numeral 175, which includes a bracket 176 secured by a screw 177 to the top of the crossbar 22, the bracket 176 preferably having an elongated aperture for the screw 177 to permit adjustment of the bracket position. Secured to the bracket 176 is a helical compression spring 178 which extends forwardly through an opening in the support plate 66 and has secured to the forward end thereof a brake pad of leather or the like, disposed in frictional engagement with the rear surface of the crank 117, this engagement being accommodated by the broad shape of the crank 117.

Referring now also to FIGS. 4 through 16 of the drawings, the operation of the wire stitching machine 20 will be described in detail. Initially, the machine 20 is disposed in the configuration illustrated in FIGS. 1 through 3, with the clutch assembly 40 released from the drive wheel 30 and with the parts of the stitching head 80 disposed in their fully-retracted condition. First, a length of wire 70 is withdrawn from the associated coil and is manually fed into the stitching head 80. For this purpose, the latch hook 167 is withdrawn to release the spring arm 165 and allow the mounting arm 162 and feed roll 160 to pivot downwardly away from the feed roll 151, in a counterclockwise direction as viewed in FIG. 2. It is an important feature of the present invention that the mounting of the feed roll 160 on the pivoting mounting arm 162 permits it to be moved completely away from the feed roll 151, the mounting arm 162 being capable of pivotal movement well in excess of ninety degrees away from the engaged position shown in FIG. 2. This greatly facilitates the manual insertion of the feed portion 72 of the wire 70 between the feed rolls 151 and 160.

The leading end 73 of the wire 70 is then inserted into the guide groove 171 of the wire guide block 170, which exits directly into the groove 123 in the anvil 120. The wire 71 is inserted until the leading end 73 thereof abuts against the wire stop washer 141, the feed portion 72 of the wire being held in place by the retainer 172. The feed roll 160 is then pivoted back up into meshing engagement with the feed roll 151, and the spring arm 165 is latched in place behind the latch hook 167, thereby firmly gripping the feed portion 72 of the wire between the wire feed surfaces of the feed rolls 151 and 160.

The user then inserts the workpiece 65 between the clincher 61 and the stitching head 80, with the portion to be stapled positioned directly over the clincher 61, this insertion of the workpiece 65 being permitted by the elevated position of the finger guard 55. Once the drive motor 25 has been turned on, the drive wheel 30 rotates continuously, but the drive shaft 32 remains stationary as long as the clutch assembly 40 is in its release position illustrated in FIG. 1. When it is desired to operate the machine 20 to drive a staple into the workpiece 65, the foot pedal is depressed, thereby activating the clutch actuating assembly 50. More particularly, the lever bracket 52 is raised, thereby simultaneously lowering the front arm 59 of the finger guard 55 to a position immediately in front of the clincher 61. When the finger guard 55 has been lowered to this guard position, the stud 54 will have been elevated into engagement with the clutch plate 46 for pivoting it against the urging of the bias spring 49 out of engagement with the cam finger 45 of the clutch member 41.

It will be appreciated that if the user's hand is disposed over the clincher 61, the finger guard 55 will not be able to move to its guard position and, therefore, the stud 54 will not be able to move into engagement with the clutch plate 46 for actuating the stitching head 80. In that case, the upward movement of the connecting rod and spring rod 51 are absorbed by compression of the spring 53 as the spring rod 51 slides upwardly through the aperture in the lever bracket 52. Thus, operation of the stitching head 80 is positively prevented until the user's hands have been removed from the stapling region above the clincher 61.

As soon as the clutch member 41 has been released from the clutch plate 46, it pivots clockwise, as viewed in FIG. 1 under the urging of the leaf spring 43 to the drive position, wherein it will engage the next one of the drive lugs 35 to rotate past, for rotation of the clutch member 41 and the drive shaft 32 by the drive wheel 30. If it is desired to drive a single staple, the foot pedal is only momentarily depressed. Upon its release the clutch plate 46 is pulled back to its deactuating position by the spring 49 wherein it cammingly engages the cam finger 45 of the clutch member 41 after the drive shaft 32 has undergone one complete revolution, for moving the clutch member 41 back to its release position illustrated in FIG. 1 to disengage the drive shaft 32 from the drive wheel 30. Thus, for each momentary actuation of the clutch actuating assembly 50, the drive shaft 32 will undergo one complete revolution, the parts being so arranged that this revolution will be sufficient to drive the stitching head 80 through one complete staple-forming and driving cycle.

Figure 5:
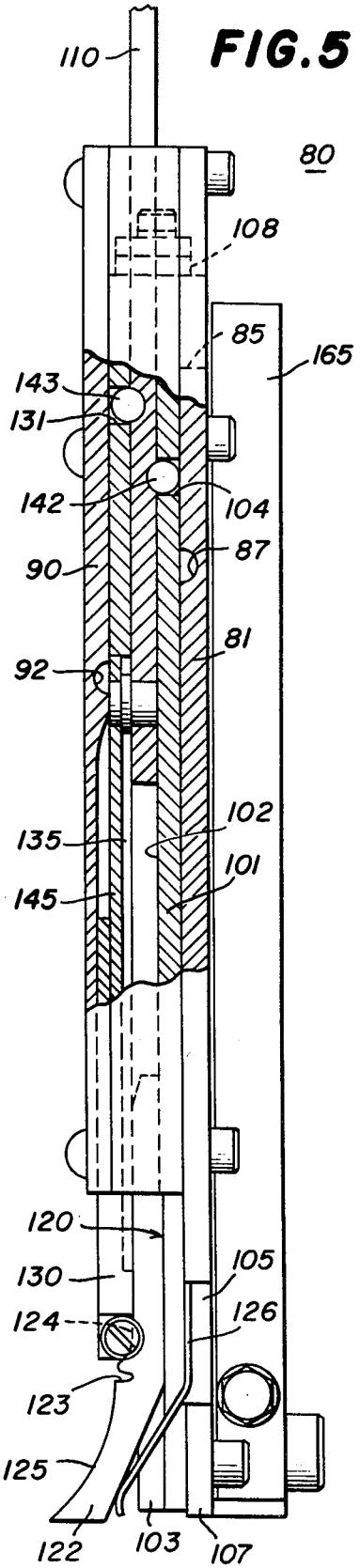
FIG. 5 is a view similar to FIG. 3, but illustrating the parts in their position shown in FIG. 4.

The rotation of the drive shaft 32 effects a vertically reciprocating movement of the drive bar 110 as described above, the drive bar 110 initially moving downwardly in its drive stroke from the fully-retracted position illustrated in FIGS. 1 through 3. By reason of the coupling action of the shift pins 142 and 143, this downward movement of the drive bar 110 simultaneously drives the support assembly 100 and the staple former 130 downwardly and, through the coupling action of the attachment pin 113, drives the staple driver 145 downwardly, as indicated in FIGS. 4 and 5. The downward movement of the support assembly 100 effects a corresponding downward movement of all the parts carried thereby, including the anvil 120 and the wire feed assembly 150.

As the support plate 105 moves downwardly, the feed lever 153 rotates in a clockwise direction about the axis of the shaft 152 under the action of the feed link 154, thereby causing the pawl 156 to ratchet upwardly along the teeth of the feed roll 151, while the feed rolls 151 and 160 remain stationary with respect to the support plate 105. As the feed rolls 151 and 160 translate downwardly without rotating, they pull a supply length of wire 70 from the associated coil thereof, while firmly holding feed portion 72 of the wire in position in the wire guide block 170 and anvil 120. Therefore, the wire 70 is withdrawn from the associated coil by a simple downward movement of the support assembly 100 at a time when none of the driving power is being consumed in rotating the feed rolls 151 and 160, thereby effecting a more positive and efficient withdrawing of the wire 70 from the supply coil thereof.

Thus, during the initial movement of the drive bar 110 downwardly along its drive stroke, the support assembly 100, staple former 130 and staple driver 145 are all moving together with respect to the head frame 95. This simultaneous movement continues until the parts approach the position illustrated in FIGS. 6 and 7. When the shift pin 142 arrives at the recess 87 in the rear plate 81, the stop pad 108 on the slide plate 101 will engage the stop surface 85 on the rear plate 81, thereby preventing further downward movement of the slide plate 101 and support assembly 100 with respect to the head frame 95. The continued downward movement of the drive bar 110 thus cams the shift pin 142 into the rear plate recess 87 and out of the path of the drive bar 110. This continued downward movement of the drive bar 110 moves the staple former 130 and the staple driver 145 downwardly with respect to the now-stationary support assembly 100. It can be seen that the feed portion 72 of the wire 70 which is positioned in the groove 123 of the anvil 120 is disposed in the path of the staple former 130, and as the staple former 130 moves downwardly, the cutter blade 140 severs the leading end of the wire at the inner end of the wire guide block 170, and the lower legs of the staple former 130 defined by the cutout 138 straddle the shoe portion 122 of the anvil 120 and cooperate therewith to bend the staple 75 downwardly therearound.

Figure 8:
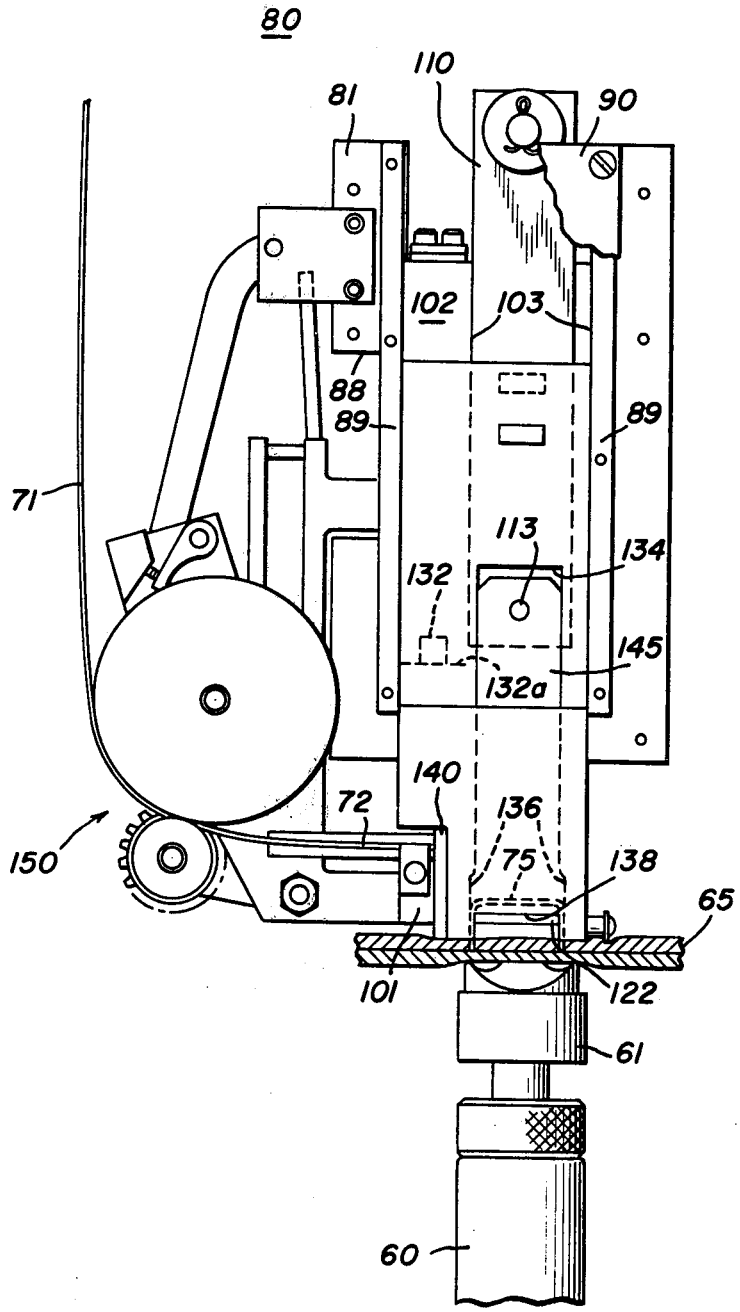
FIG. 8 is a view similar to FIG. 6, but illustrating the parts still further along a drive stroke with the staple fully formed and partially driven into the workpiece.

Referring now also to FIGS. 8 and 9 of the drawings, as the staple former 130 continues moving downwardly under the action of the drive bar 110, the staple 75 is formed down around the shoe portion 122 of the anvil 120, with the side legs of the staple 75 being received upwardly in the staple grooves 136 of the staple former 130. This action is permitted by the fact that the drive surface 148 of the staple driver 145 comes into camming engagement with the upper camming surface 124 of the anvil 120, thereby tilting the anvil 120 back out of the path of the staple former 130 against the urging of the leaf spring 126 for disengaging the staple 75 from the anvil groove 123.

The downward movement of the staple former 130 continues until the stud 132 engages the stop surface **132*a* on the stationary slide plate 101, thereby preventing further downward movement of the staple former 130 with respect to the support assembly 100 and the head frame 95. The continued downward movement of the drive bar 110 cams the shift pin 143 into the front plate recess 92 and out of the path of the drive bar 110. As the drive bar 110 moves downwardly, it continues to drive only the staple driver 145, the drive surface 148 of which cammingly engages the lower camming surface 125 of the anvil 120 to continue tilting it rearwardly, the drive surface 148 ultimately being brought into driving engagement with the formed staple 75 for driving it out of the staple grooves 136 in the staple former 130 and into the workpiece 65 (see FIG. 8). The anvil 120 cooperates with the staple former 130 to support the staple 75 therebetween until the anvil 120** has been tilted completely back.

Figure 10:
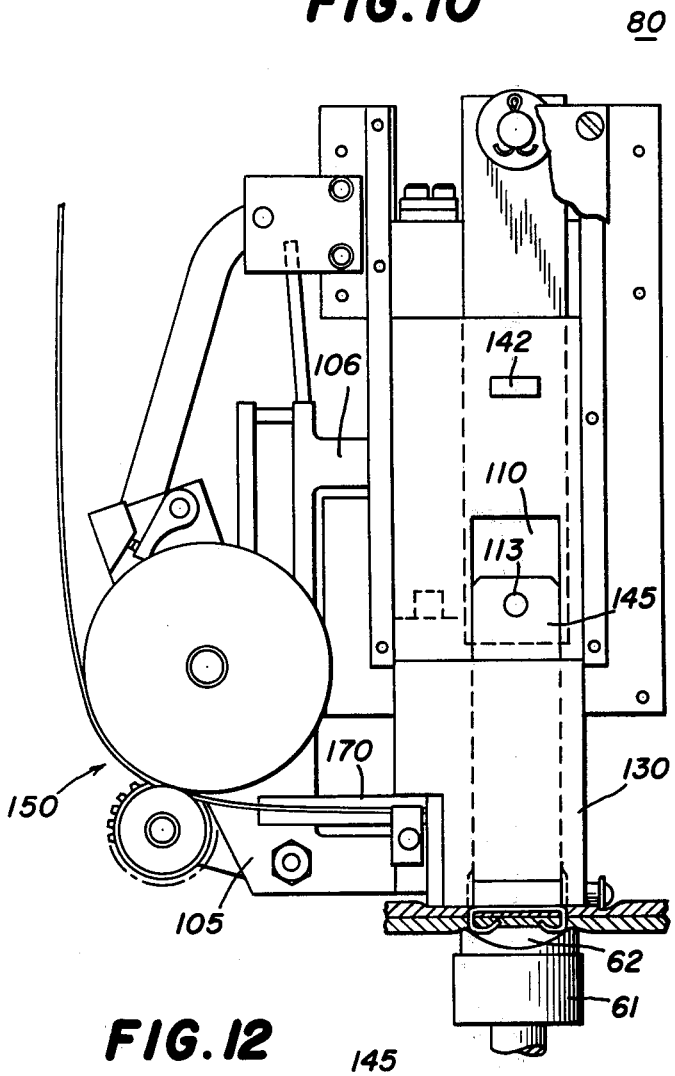
FIG. 10 is a view similar to FIG. 8, and illustrating the parts at the bottom of a drive stroke with the staple fully driven into the workpiece.
Figure 11:
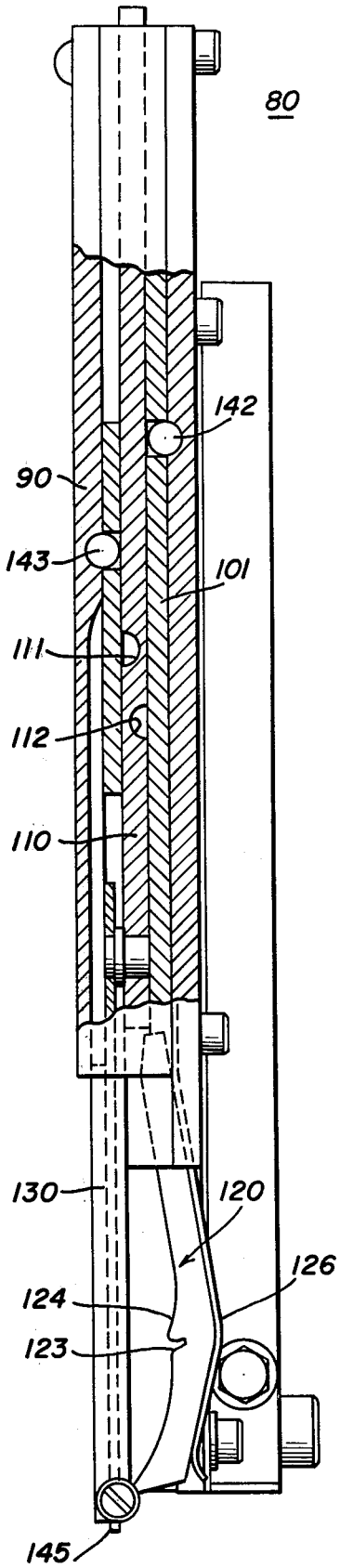
FIG. 11 is a view similar to FIG. 9, but illustrating the parts in the positions shown in FIG. 10.
Figure 12:
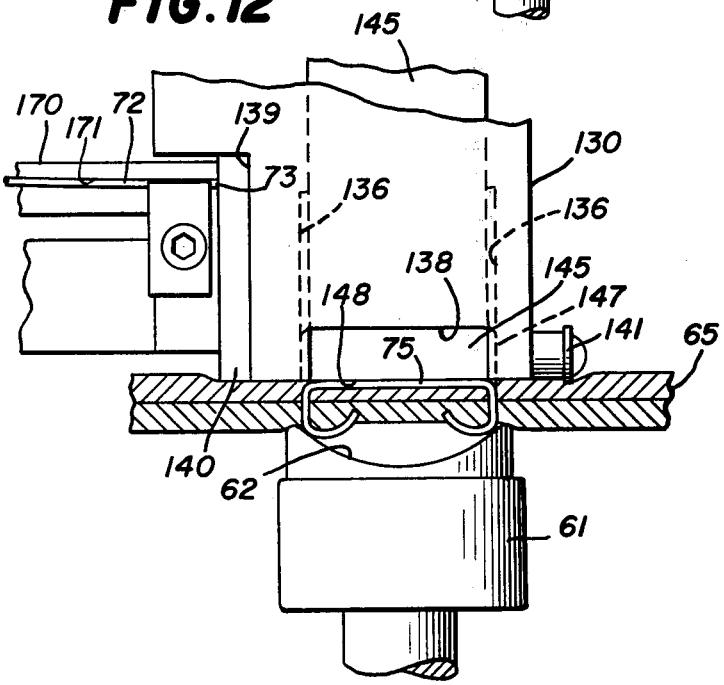
FIG. 12 is an enlarged fragmentary view of a portion of FIG. 10 illustrating the joinder of the staple and workpiece.
Figure 13:
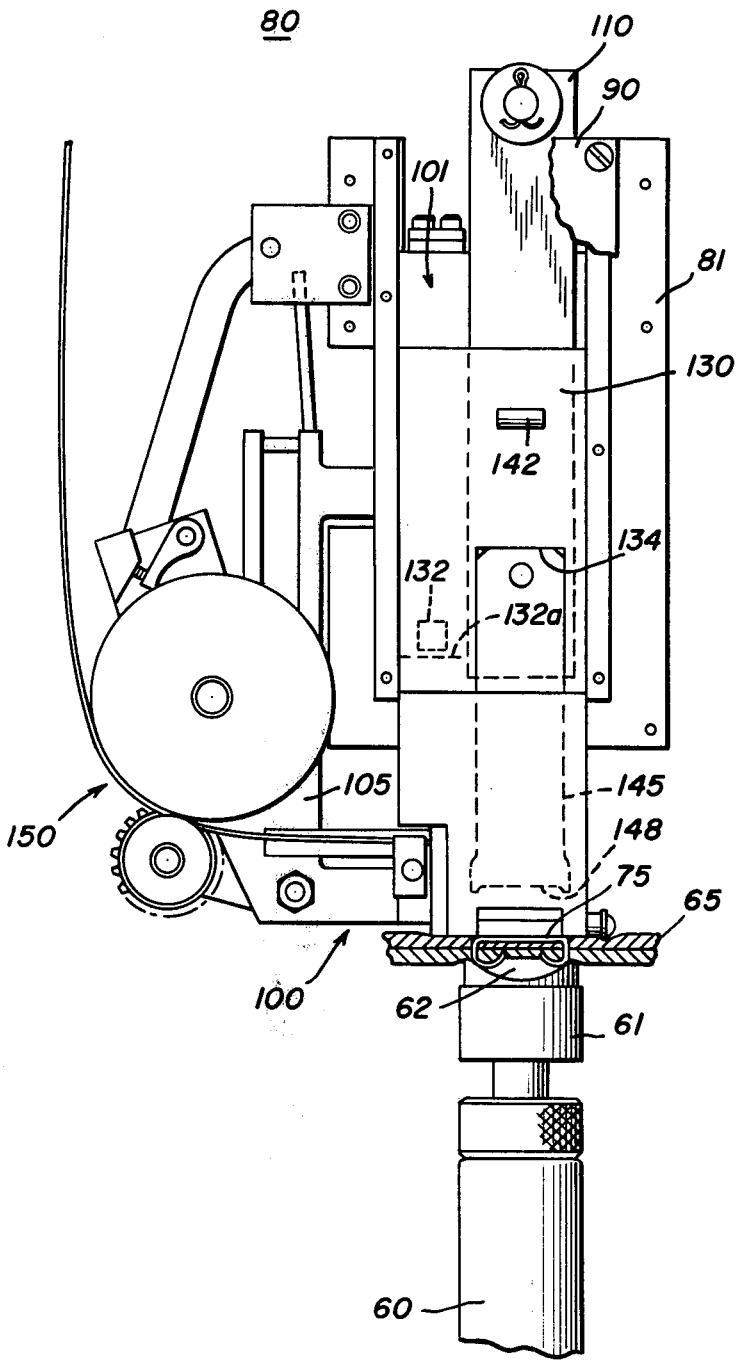
FIG. 13 is a view similar to FIG. 10, illustrating the parts in their position partway along the retraction stroke.
Figure 14:
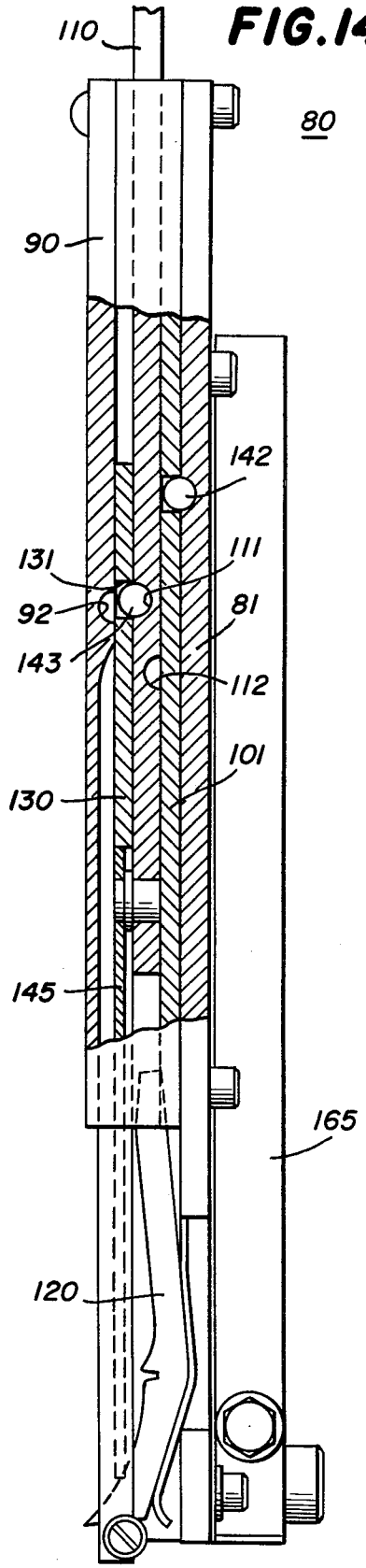
FIG. 14 is a view similar to FIG. 11, but illustrating the parts in the position shown in FIG. 13.

Referring to FIGS. 10 through 12 of the drawings, the drive bar 110 continues downwardly until, at the bottom of its drive stroke, the lower end of the staple driver 145 clears the lower end of the staple former 130, having tilted the anvil 120 completely back out of the path of the staple former 130. As the legs of the staple 75 are driven through the workpiece 65, they engage the guide surface 62 of the clincher 61 and are folded back up into the underside of the workpiece 65 in a well-known manner for completion of the stapling operation.

As the crank 117 continues to rotate, the drive bar 110 begins to move upwardly along its retraction stroke, pulling the staple driver 145 upwardly out of engagement with the staple 75 and into the staple former 130. The upper end of the staple driver 145 engages the top of the opening 134 in the staple former 130 at the same time that the recess 111 in the drive bar 110 arrives opposite the shift pin 143. This engagement pulls the staple former 130 upwardly along with the staple driver 145, thereby camming the shift pin 143 into the recess 111 in the drive bar 110 and out of engagement with the front plate 90. As the staple driver 145 and staple former 130 are retracted, the anvil 120 is pushed back to its original forming position under the urging of the leaf spring 126.

Figure 15:
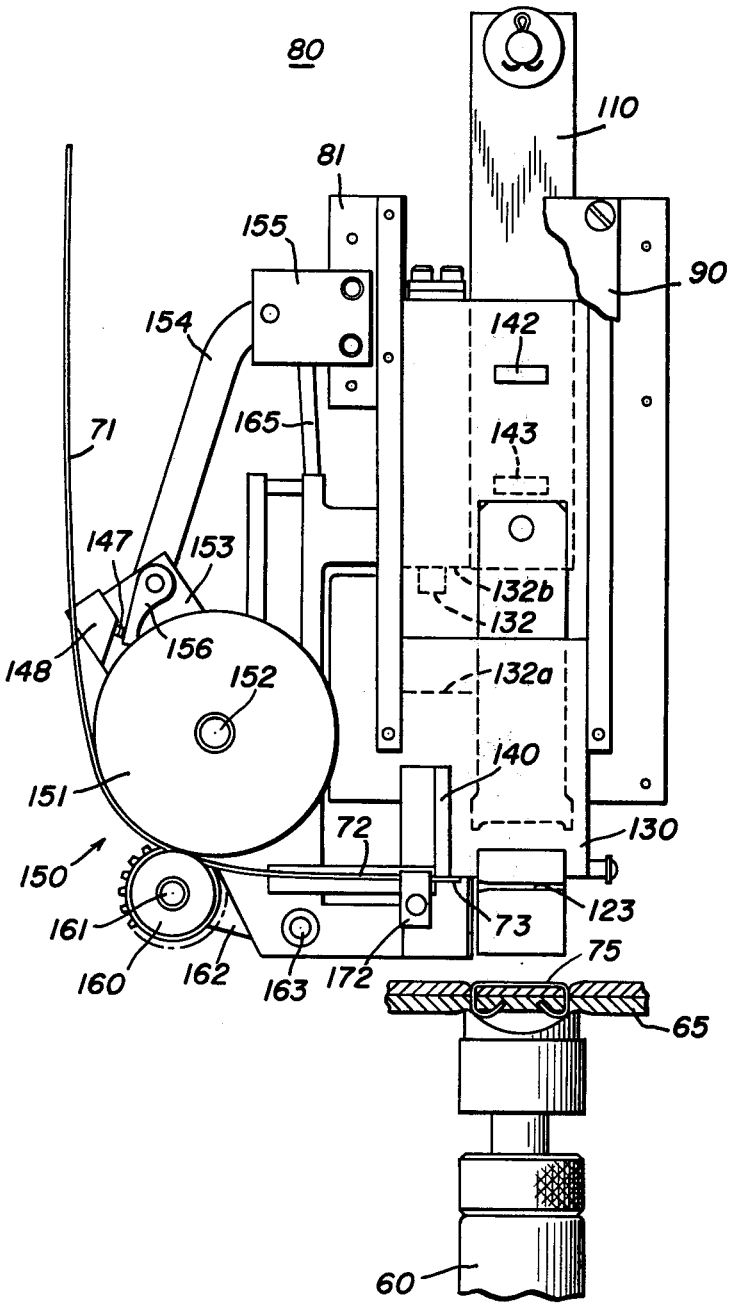
FIG. 15 is a view similar to FIG. 13, but illustrating the parts still further along the retraction stroke.
Figure 16:
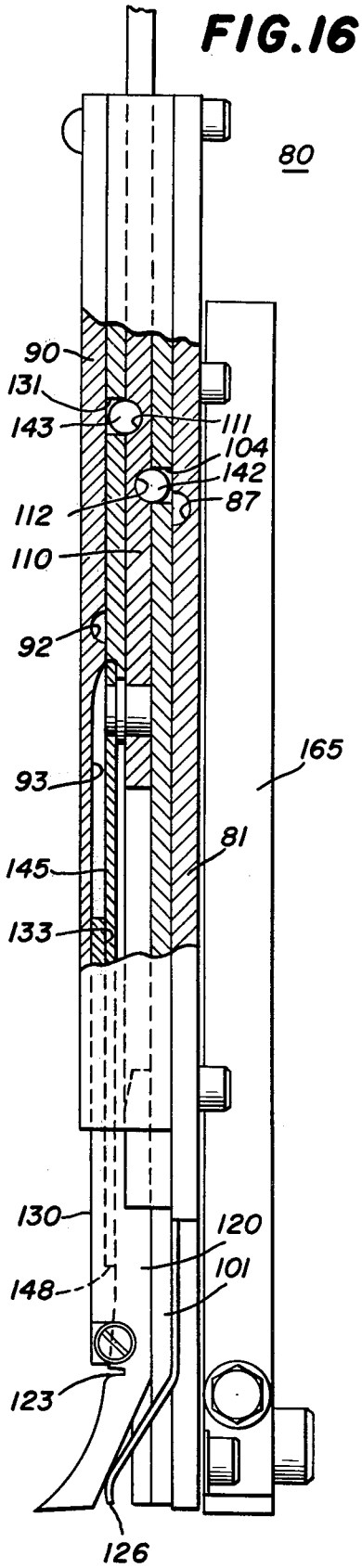
FIG. 16 is a view similar to FIG. 14, but illustrating the parts in the positions shown in FIG. 15.

Referring to FIGS. 15 and 16 of the drawings, as the retraction of the drive bar 110 continues, the stud 132 on the staple former 130 engages the stop surface **132*b* on the slide plate 101 at the same time as the aperture 112 in the drive bar 110 arrives opposite the shift pin 142. This engagement pulls the slide plate 101 and support assembly 100 upwardly along with the staple former 130, whereupon the slide plate 101 cams the shift pin 142 into the recess 112 in the drive bar 110 and out of engagement with the rear plate 81**.

As the support assembly 100 begins to retract, the feed link 154 acts upon the feed lever 153 and pawl 156 to rotate the feed roll 151 in a counterclockwise direction, as viewed in FIG. 15, since the pawl 156 prevents rotation of the feed lever 153 with respect to the feed roll 151. The rotation of the feed roll 151 causes a counter rotation of the feed roll 160 for feeding the supply portion 71 of the wire which had been withdrawn from the associated coil during the drive stroke of the drive bar 110. Thus, the new leading end 73 of the wire at the point where the previous staple 75 had been severed is moved to the right into the groove 123 of the anvil 120, which has now been returned to its original forming position.

Preferably, the parts are so dimensioned and arranged that, when the drive bar 110 and the support assembly 100 return to their original fully retracted position, the leading end 73 of the wire 70 will have been fed to the wire stop washer 141 so that the entire stitching machine 20 is now in condition for the next staple-forming and driving operation. In this regard, it will be appreciated that the brake assembly 175 is adjusted to apply just enough braking force to the crank 117 so that, after disengagement of the clutch member 41, the drive bar 110 will coast just to its fully-retracted position. This is important since, rotation of the drive shaft 32 is stopped too quickly, the drive pins 35 will noisily strike the clutch member 41 and, if the machine overruns the fully retracted position, the clutch member 41 may ride all the way past the clutch plate 46 and move back into driving engagement with the drive wheel 30 and begin a new cycle.

While the operation of the wire stitching machine 20 has been described in connection with a single staple-forming and driving operation in response to a momentary operation of the clutch actuating assembly 50, it will be appreciated that the foot pedal could be held down continuously so that the clutch assembly 40 remains engaged and the stitching head 80 repeatedly cycles through staple-forming and driving operations. In this continuous-type operation, the workpiece 65 may be intermittently moved, either manually or automatically, sequentially to bring the portions to be stapled into the stapling region.

From the foregoing, it can be seen that there has been provided an improved wire stitching machine which overcomes the disadvantages of prior art machines while affording operating and constructional advantages. More particularly, there has been provided a wire stitching machine having a stitching head of thin, flat design which provides a significant economy of space. This thin design may be particularly useful in wire stitching machines having multiple stitching head mountings. Furthermore, it will be appreciated that the wire stitching machine of the present invention is of such a design as to allow extensive use of stampings for ease and economy of manufacture.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. In a wire stitching machine including a head frame and staple-forming and driving mechanism and operating means therefor, the combination comprising a support adapted for movement with respect to the head frame, an anvil member coupled to said support for movement therewith and adapted for holding an associated length of wire, and coupling means coupling the operating means to the staple-forming and driving mechanism and to said support for effecting movement thereof, said coupling means being responsive to an initial movement of the operating means for effecting simultaneous movement of the staple-forming and driving mechanism and said support, said coupling means being responsive to further movement of the operating means for arresting movement of said support with respect to the head frame while permitting continued movement of the staple-forming and driving mechanism with respect to said support and the head frame.

2. The combination of claim 1, wherein said support is adapted for reciprocating movement with respect to the head frame.

3. The combination of claim 1, wherein said support is slidably movable with respect to the head frame.

4. The combination of claim 1, wherein said coupling means includes first means coupled to said support and movable between an operating position in engagement with the operating means and out of engagement with the head frame for accommodating movement of said support by the operating means and a stop position in engagement with the head frame and out of engagement with the operating means for arresting movement of said support, and second means for coupling the staple-forming and driving mechanism to the operating means.

5. The combination of claim 4, wherein each of the head frame and the operating means and said support has an aperture herein, said first means comprising a shift pin having a thickness greater than the thickness of said support, said shift pin being disposed partially in said support aperture and partially in the operating means aperture in the operating condition of said first means and being disposed partly in said support aperture and partly in the head frame aperture in the stop condition of said first means.

6. In a wire stitching machine including a head frame and a staple former and a staple driver adapted for movement with respect to the head frame and rotary power means, the combination comprising converting means for converting the rotary motion of the power means to reciprocating motion, a reciprocating member coupled to said converting means for reciprocation thereby through alternating drive strokes and retraction strokes, first coupling means coupling the staple driver to said reciprocating member for reciprocation therewith, and second coupling means coupling the staple former to said reciprocating member, said second coupling means being responsive to an initial movement of said reciprocating member along a drive stroke for effecting reciprocating movement of the staple former simultaneously with the staple driver, said second coupling means being responsive to further movement of said reciprocating member along the drive stroke for arresting movement of the staple former while permitting continued movement of the staple driver by said reciprocating member.

7. The combination of claim 6, wherein said first coupling means comprises a pin fixedly secured to said reciprocating member and disposed in engagement with the staple driver so that the staple drive follows the movements of said reciprocating member.

8. In a wire stitching machine including a head frame and a staple former and a staple driver adapted for movement with respect to the head frame and rotary power means, the combination comprising converting means for converting the rotary motion of the power means to a reciprocating motion, a reciprocating member coupled to said converting means for reciprocation thereby through alternating drive strokes and retraction strokes, each of the head frame and the staple former and said reciprocating member having an aperture therein, first coupling means coupling the staple driver to said reciprocating member for reciprocation therewith, and second coupling means coupling the staple former to said reciprocating member, said second coupling means including a shift pin having a thickness greater than the thickness of the staple former and being movable between an operating condition and a stop condition, said shift pin in the operating condition thereof being disposed partially in said reciprocating member aperture and partially in the staple former aperture and being responsive to an initial movement of said reciproacting member along a drive stroke for effecting reciprocating movement of the staple former simultaneously with the staple driver, said shift pin in the stop position thereof being disposed partially in the staple former aperture and partially in the head frame aperture and being responsive to further movement of said reciprocating member along the drive stroke for arresting movement of the staple former while permitting continued movement of the staple driver by said reciprocating member.

9. In a wire stitching machine including a head frame and a staple former and a staple driver adapted for movement with respect to the head frame and rotary power means, the combination comprising a support adapted for movement with respect to the head frame, an anvil member coupled to said support for movement therewith and adapted for holding an associated length of wire, converting means for converting the rotary motion of the power means to reciprocating motion, a reciprocating member coupled to said converting means for reciprocation thereby through alternating drive strokes and retraction strokes, first coupling means coupling the staple driver to said reciprocating member for reciprocation therewith, second coupling means coupling said support to said reciprocating member for reciprocating movement thereby, and third coupling means coupling the staple former to said reciprocating member for reciprocating movement thereby, initial movement of said reciprocating member along a first portion of a drive stroke causing said first and second and third coupling means respectively to effect corresponding movements of the staple driver and said support and the staple former, continued movement of said reciprocating member along an intermediate portion of the drive stroke causing said first and third coupling means respectively to effect corresponding continued movements of the staple driver and the staple former while causing said second coupling means to arrest movement of said support, further continued movement of said reciprocating member along a terminal portion of the drive stroke causing said first coupling means to effect a corresponding further continued movement of the staple driver while causing said third coupling means to arrest movement of the staple former.

10. The combination of claim 9, wherein said first coupling means comprises a pin fixedly secured to said reciprocating member and disposed in engagement with the staple driver so that the staple driver follows the movements of said reciprocating member, the staple former and said support each having an aperture therein and the head frame and said reciprocating member each having two apertures therein, said second coupling means including a support shift pin having a thickness greater than the thickness of said support and being movable between an operating condition and a stop condition, said support shift pin in the operating condition thereof being disposed partially in said support aperture and partially in one of said reciprocating member apertures and in the stop condition thereof being disposed partially in said support aperture and partially in one of the head frame apertures, said third coupling means including a former shift pin having a thickness greater than the thickness of the staple former and being movable between an operating condition and a stop condition, said former shift pin in the operating condition thereof being disposed partially in the other of said reciprocating member apertures and partially in the staple former aperture and in the stop condition thereof being disposed partially in the staple former aperture and partially in the other of said head frame apertures.

11. In a wire stitching machine including a support and staple-forming driving mechanism having a pair of laterally spaced-apart forming surfaces for forming a staple from a length of wire and a driving surface for driving the formed staple, the combination comprising an integral anvil member adapted for holding an associated length of wire and being coupled to the support for movement with respect thereto between a forming position and a driving position, bias means resiliently urging said anvil member toward the forming position thereof, said anvil member having a shoe portion disposed in the path of the driving surface and between the forming surfaces for cooperation therewith to form the staple when said anvil member is disposed in the forming position thereof, said anvil member in the driving position thereof being disposed out of holding relationship with the length of wire with said shoe portion being disposed out of the path of the driving surface, said anvil member in the forming position thereof being disposed for camming engagement with the driving surface for cammed movement of said anvil member to the driving position thereof thereby freeing the formed staple for driving thereof by the driving surface.

12. The combination of claim 11, wherein said anvil member is of unitary one-piece construction.

13. The combination of claim 11, wherein said anvil member has a front surface disposed substantially upright in use, and a groove formed in said front surface and extending laterally thereacross for holding the associated length of wire therein.

14. The combination of claim 13, wherein said front surface of said anvil member has a camming portion disposed for camming engagement with the driving surface for moving said anvil member to the driving position thereof after formation of the staple.

15. The combination of claim 11, wherein said anvil member is coupled to the support for tilting movement between the forming and driving positions.

16. In a wire stitching machine including a head frame and staple-forming and driving mechanism movable with respect to the head frame in a drive direction for severing and forming a staple from a continuous wire supplied from a coil thereof and for driving the formed staple and movable in a retraction direction to prepare for formation of the next staple, the combination comprising a support adapted for movement with respect to the head frame in the drive and retraction directions, two feed rolls coupled to said support for movement therewith and disposed in meshing engagement with each other respectively for rotation in opposite directions about parallel axis, said feed rolls respectively having feed surfaces for securely gripping a feed portion of the associated wire therebetween to feed the leading end of the wire to a staple-forming configuration, pawl means coupled to said support and to the head frame and engageable with said feed rolls for preventing rotation thereof during movement of said support in the drive direction thereby to hold the leading end of the wire in the staple-forming configuration and fixed with respect to said feed rolls while withdrawing a supply length of wire from the associated coil, said pawl means being responsive to movement of said support in the retraction direction for rotating said feed rolls to feed the withdrawn supply length of wire therethrough and move the new leading end of the wire to said staple-forming configuration.

17. The combination of claim 16, wherein said pawl means includes linkage means pivotally coupled to the head frame and to said support for interconnecting same while accommodating relative movement thereof, and a pawl member pivotally carried by said linkage means for ratcheting engagement with one of said feed rolls.

18. The combination of claim 16, wherein said support is reciprocally movable with respect to the head frame so that the drive and retraction directions are opposite to each other.

19. The combination of claim 16, and further including a mounting arm pivotally connected to said support, one of said feed rolls being carried by said mounting arm for pivotal movement therewith toward and away from the other feed roll to facilitate insertion of the wire therebetween.

20. The combination of claim 19, wherein said mounting arm is pivotally movable on said support through an angle of at least ninety degrees.

21. The combination of claim 19, and further including means for holding said one feed roll in meshing engagement with said other feed roll.

22. In a wire stitching machine including a head frame and staple-forming and driving mechanism movable with respect to the head frame in a drive direction for severing and forming a staple from a continuous wire supplied from a coil thereof and for driving the formed staple and movable in a retraction direction to prepare for formation of the next staple and operating means therefor, the combination comprising a support adapted for movement with respect to the head frame in the drive and retraction directions, two feed rolls coupled to said support for movement therewith and disposed in meshing engagement with each other respectively for rotation in opposite directions about parallel axes, said feed rolls respectively having feed surfaces for securely gripping a feed portion of the associated wire therebetween to feed the leading end of the wire to a staple-forming configuration, an anvil member coupled to said support for movement therewith and adapted for holding the associated wire adjacent to the leading end thereof in a staple-forming configuration, coupling means coupling the operating means to the staple-forming and driving mechanism and to said support for effecting movement thereof in the drive and retraction directions, said coupling means being responsive to an initial movement of the operating means for effecting simultaneous movement of the staple-forming and driving mechanism and said support in the drive direction, and pawl means coupled between the head frame and said support and engageable with said feed rolls for preventing rotation thereof during movement of said support in the drive direction thereby to hold the leading end of the wire in the staple-forming configuration while withdrawing a supply length of wire from the associated coil, said coupling means being responsive to further movement of the operating means for arresting movement of said support in the drive direction while permitting continued movement of the staple-forming and driving mechanism in the drive direction for severing and forming and driving a staple, said pawl means being responsive to movement of said support in the retraction direction for rotating said feed rolls to feed the supply length of wire therethrough and move the new leading end of the wire to the staple-forming configuration.

23. In a wire stitching machine including a head frame and a staple former having a pair of laterally spaced-apart forming surfaces for severing and forming a staple from a continuous wire supplied from a coil thereof and a staple driver and rotary power means, the combination comprising converting means for converting the rotary motion of the power means to reciprocating motion, a reciprocating member coupled to said converting means for reciprocation thereby through alternating drive strokes and retraction strokes, a support adapted for movement with respect to the head frame, first coupling means coupling the staple driver to said reciprocating member for reciprocation therewith, second coupling means coupling said support to said reciprocating member for reciprocating movement thereby, third coupling means coupling the staple former to said reciprocating member for reciprocating movement thereby, two feed rolls coupled to said support for movement therewith and disposed in meshing engagement with each other respectively for rotation in opposite directions about parallel axes, said feed rolls respectively having feed surfaces for securely gripping a feed portion of the associated wire therebetween to feed the leading end of the wire to a staple-forming configuration, an integral anvil member adapted for holding the associated wire adjacent to the leading end thereof in the staple-forming configuration and being coupled to said support for movement therewith and for movement with respect thereto between a forming position and a driving position, bias means resiliently urging said anvil member toward the forming position thereof, initial movement of said reciprocating member along a first portion of a drive stroke causing said first and second and third coupling means respectively to effect corresponding movements of the staple driver and said support and the staple former, pawl means coupled between the head frame and said support and engageable with said feed rolls for preventing rotation thereof during movement of said support during a drive stroke thereby to hold the leading end of the wire in the staple-forming configuration while withdrawing a supply length of wire from the associated coil, continued movement of said reciprocating member along an intermediate portion of the drive stroke causing said first and third coupling means respectively to effect corresponding continued movements of the staple driver and the staple former while causing said second coupling means to arrest movement of said support, said anvil member having a shoe portion disposed in the path of the staple driver and between the forming surfaces of the staple former for cooperation therewith to form the staple when said anvil member is disposed in the forming position thereof, said anvil member in the driving position thereof being disposed out of holding relationship with the length of wire with said shoe portion being disposed out of the path of the driving surface, further continued movement of said reciprocating member along a terminal portion of the drive stroke causing said dirst coupling means to effect a corresponding further continued movement of the staple driver while causing said third coupling means to arrest movement of the staple former, said anvil member in the forming position thereof being disposed for camming engagement with the staple driver for cammed movement of said anvil member to the driving position thereof thereby freeing the formed staple for driving thereof by the staple driver, said pawl means being responsive to movement of said support during a retraction stroke for rotating said feed rolls to feed the supply length of wire therethrough and move the new leading end of the wire to the staple-forming configuration.

24. In a wire stitching machine including a stitching head for forming and driving metal staples and a rotary drive shaft therefore, the combination comprising a drive wheel mounted on the drive shaft for free rotation about the axis thereof and adapted to be coupled to an associated power source, a clutch member carried by the drive shaft for rotation therewith and for pivotal movement about a pivot axis perpendicular to the axis of rotation of the drive shaft between a drive position disposed in driving engagement with said drive wheel and a release position disposed out of driving engagement with said drive wheel, bias means resiliently urging said clutch member toward the drive position thereof, and actuating means movable between a deactuating position disposed in engagement with said clutch member for holding it in the release position thereof and an actuating position disposed out of engagement with said clutch member for accommodating movement thereof to the drive position thereof under the action of said bias means.

25. The combination of claim 24, wherein said clutch member is disposed substantially tangentially of the drive shaft.

26. The combination of claim 24, and further including a drive lug carried by said drive wheel for driving engagement with said clutch member in the drive position thereof.

27. The combination of claim 24, and further including means for resiliently biasing said actuating means toward the deactuating position thereof.

28. In a stitching machine having a stitching head for forming metal staples and driving them into associated work in a stapling region and clutch-controlled rotary drive means for the stitching head, the combination comprising clutch-actuating means movable between an actuating position for operating the stitching head and a deactuating position, a finger guard mechanically coupled to said clutch-actuating means for movement therewith between a stapling position preventing the insertion of a user's hand into the stapling region and a work feed position accommodating manipulation of a workpiece in the stapling region, said stapling position of said finger guard corresponding to said actuating position of said clutch-actuating means and said work feed position of said finger guard corresponding to said deactuating position of said clutch-actuating means, the presence of a user's hand in the stapling region effectively preventing movement of said finger guard to the stapling position thereof thereby to prevent movement of said clutch-actuating means to the actuating position thereof.

29. The combination of claim 28, wherein said finger guard comprises an elongated generally L-shaped bar extending alongside and in front of the stapling region in the stapling position thereof.

30. The combination of claim 28, wherein said clutch-actuating means includes a foot-operated pedal.

31. In a stitching machine having a stitching head for forming metal staples and driving them into associated work in a stapling region and a rotary drive shaft therefor, the combination comprising a drive wheel mounted on the drive shaft for free rotation about the axis thereof and adapted to be coupled to an associated power source, a clutch member carried by the drive shaft for rotation therewith and for pivotal movement about a pivot axis perpendicular to the axis of rotation of the drive shaft between a drive position disposed in driving engagement with said drive wheel and a release position disposed out of driving engagement with said drive wheel, bias means resiliently urging said clutch member toward the drive position thereof, actuating means movable between a deactuating position disposed in engagement with said clutch member for holding it in the release position thereof an an actuating position disposed out of engagement with said clutch member for accommodating movement thereof to the drive position thereof under the action of said bias means, a finger guard mechanically coupled to said actuating means for movement therewith between a stapling position preventing the insertion of a user's hand into the stapling region and a work feed position accommodating manipulation of a workpiece in the stapling region, said stapling position of said finger guard corresponding to said actuating position of said clutch-actuating means and said work feed position of said finger guard corresponding to said deactuating position of said clutch-actuating means, the presence of a user's hand in the stapling region effectively preventing movement of said finger guard to the stapling position thereof thereby to prevent movement of said clutch-actuating means to the actuating position thereof.

* * * * *